US008181834B1

(12) United States Patent
Howell

(10) Patent No.: US 8,181,834 B1
(45) Date of Patent: May 22, 2012

(54) BACKPACK

(75) Inventor: Frank A. Howell, Oxford, ME (US)

(73) Assignee: Here be Dragons;LLC, Oxford, ME (US)

( * ) Notice: Subject to any disclaimer, the term of this patent is extended or adjusted under 35 U.S.C. 154(b) by 477 days.

(21) Appl. No.: 12/477,362

(22) Filed: Jun. 3, 2009

(51) Int. Cl.

| | |
|---|---|
| ***A45F 3/00*** | (2006.01) |
| ***A45F 4/02*** | (2006.01) |
| ***B65D 33/02*** | (2006.01) |
| ***A45C 1/02*** | (2006.01) |
| ***A45C 13/36*** | (2006.01) |

(52) U.S. Cl. ..... 224/630; 224/633; 383/119; 150/130; 190/127

(58) Field of Classification Search ..... 224/630, 224/153; 383/119; 150/130; 190/127
See application file for complete search history.

(56) References Cited

U.S. PATENT DOCUMENTS

| | | | | |
|---|---|---|---|---|
| 2,421,244 | A * | 5/1947 | Daiber | 224/263 |
| 4,114,788 | A * | 9/1978 | Zufich | 224/153 |
| 4,883,206 | A * | 11/1989 | Miller | 224/153 |
| 4,911,346 | A * | 3/1990 | Shallman | 224/631 |
| 4,934,573 | A | 6/1990 | Jaeger | |
| 5,005,744 | A * | 4/1991 | Gleason | 224/630 |
| 5,236,112 | A | 8/1993 | Robinson et al. | |
| 5,320,262 | A | 6/1994 | Levis | |
| 5,366,126 | A * | 11/1994 | Dausien | 224/630 |
| 5,503,314 | A * | 4/1996 | Fiscus | 224/665 |
| 5,564,612 | A | 10/1996 | Gregory | |
| 5,704,530 | A * | 1/1998 | Scherer | 224/632 |
| 5,762,243 | A | 6/1998 | McMaster et al. | |
| 6,135,334 | A * | 10/2000 | Seichter | 224/651 |
| 6,276,584 | B1 * | 8/2001 | McLachlan | 224/637 |
| 7,337,935 | B1 | 3/2008 | Glanville | |
| 2004/0007605 | A1 * | 1/2004 | Mares | 224/630 |
| 2005/0035170 | A1 * | 2/2005 | Sears et al. | 224/630 |
| 2006/0163305 | A1 | 7/2006 | Tong | |
| 2006/0208024 | A1 | 9/2006 | Gleason | |
| 2006/0266781 | A1 | 11/2006 | Howell | |

FOREIGN PATENT DOCUMENTS

| | | |
|---|---|---|
| EP | 0748599 | 12/1996 |
| EP | 1481609 | 12/2004 |
| FR | 541360 | 9/1921 |
| FR | 0567173 | * 10/1993 |
| GB | 1170604 | 11/1969 |
| GB | 1575250 | 9/1980 |

* cited by examiner

*Primary Examiner* — Nathan J Newhouse
*Assistant Examiner* — Derek Battisti
(74) *Attorney, Agent, or Firm* — Gesmer Updegrove LLP

(57) ABSTRACT

A backpack comprises a load carrying section with a forwardly facing front panel. A pair of mutually spaced sleeves are joined to and border the sides of the front panel. An injection molded generally U-shaped partial perimeter frame has a base bordering a bottom of the front panel, with arms projecting from the base and into the sleeves on the sides of the panel. The load carrying section of the backpack is comprised principally of fabric. The front panel is flexible and has a stiffness greater than the stiffness of the fabric forming other portions of the backpack. In one embodiment, the front panel is integrally stiffened. In another embodiment, the front panel forms a pocket configured and dimensioned to accept a flexible stiffening plate.

11 Claims, 7 Drawing Sheets

BACKPACK

BACKGROUND

1. Field of the Invention

This invention relates generally to backpacks, and is concerned in particular with a backpack formed principally of fabric, and shaped, strengthened and stabilized by an internal injection molded partial-perimeter frame.

2. Description of Related Art

Although the backpack of the present invention is useful in a wide range of applications, its design is particularly suited for use by military combat personnel.

Soldiers engaged in combat must be able to carry gear while wearing bulky body armor vests and water reservoirs (commonly known as Camelbacks or hydration reservoirs). The preferred location for these items is on the wearer's back. The difficulty is that soldiers often need to carry additional gear (such as ammunition, radios, batteries, etc.) into battle as well. The preferred location for this gear is in a back-worn pack which conflicts with their armor vest and/or hydration reservoir.

Prior art backpacks used for this purpose are typically one of two types: an all-fabric design that uses only its basic shape and support straps to stabilize and support the load; and, a plastic sheet design which adds a panel sewn or inserted into a pocket in the pack's wall adjacent to the wearer's back to protect the wearer from the pack's contents and to provide some additional support for the load. These designs do not adequately support the oft considerable weight carried in this fashion, and they do not stabilize these loads adequately during the rigors of combat.

The loads primarily carried, ammunition and the like, are very dense. Even a relatively small payload volume presents serious challenges to wearer comfort and balance. Loads will sag, thus concentrating pressure uncomfortably.

Additionally, the wearer's body armor back plate creates a convex surface on which prior art backpacks slide around. While running, climbing, crawling, etc., the load will tend to shift, thus compromising balance during critical moments. This problem is exacerbated when a hydration reservoir is worn on top of the armor plate and under the backpack.

The layering of body armor, hydration reservoir, and backpack also shifts the center of gravity of the carried load rearward, causing the wearer to bend more at the waist to maintain balance. This carriage position is inefficient and uncomfortable. Prior art backpacks that use support sheets or full-frame support systems are even more prone to this than fabric/strap designs. The rigid sheet, frame members, etc., tend to ride on the highest point on the back (in this application on the armor plate or hydration reservoir). This forces the backpack away from the wearer's center of mass and causes the load to teeter on the equipment-formed pinnacle.

SUMMARY OF THE INVENTION

A backpack in accordance with the present invention comprises a load carrying section with a forwardly facing front panel. A pair of mutually spaced sleeves are joined to and border the sides of the front panel. An injection molded generally U-shaped partial perimeter frame has a base bordering a bottom of the front panel, with arms projecting from the base and into the sleeves on the sides of the panel.

The load carrying section of the backpack is comprised principally of fabric. The front panel is flexible and has a stiffness greater than the stiffness of the fabric forming other portions of the backpack. In one embodiment, the front panel is integrally stiffened. In another embodiment, the front panel forms a pocket configured and dimensioned to accept a flexible stiffening plate.

In both embodiments, the front panel is suspended between the frame arms inserted in the sleeves. Thus suspended, the front panel can flex inwardly and outwardly, as needed, to create space for the wearer's back-borne equipment. Front panel flexure thus optimizes load centering and stability on the ever changing convex surface of the wearer's back.

Preferably, the base of the frame has a generally flat midsection with forwardly curved resiliently flexible end sections from which the arms project into the sleeves bordering the sides of the front panel. A flexible web extends between the end sections of the base at a location spaced forwardly from the base midsection.

Preferably, the arms of the frame are generally concave in the forwardly facing direction, with a longitudinal twist that gradually diminishes from the base to the distal ends of the arms.

These and other features and attendant advantages of the present invention will now be described in greater detail with reference to the accompanying drawings, wherein:

DETAILED DESCRIPTION

Figure 1:
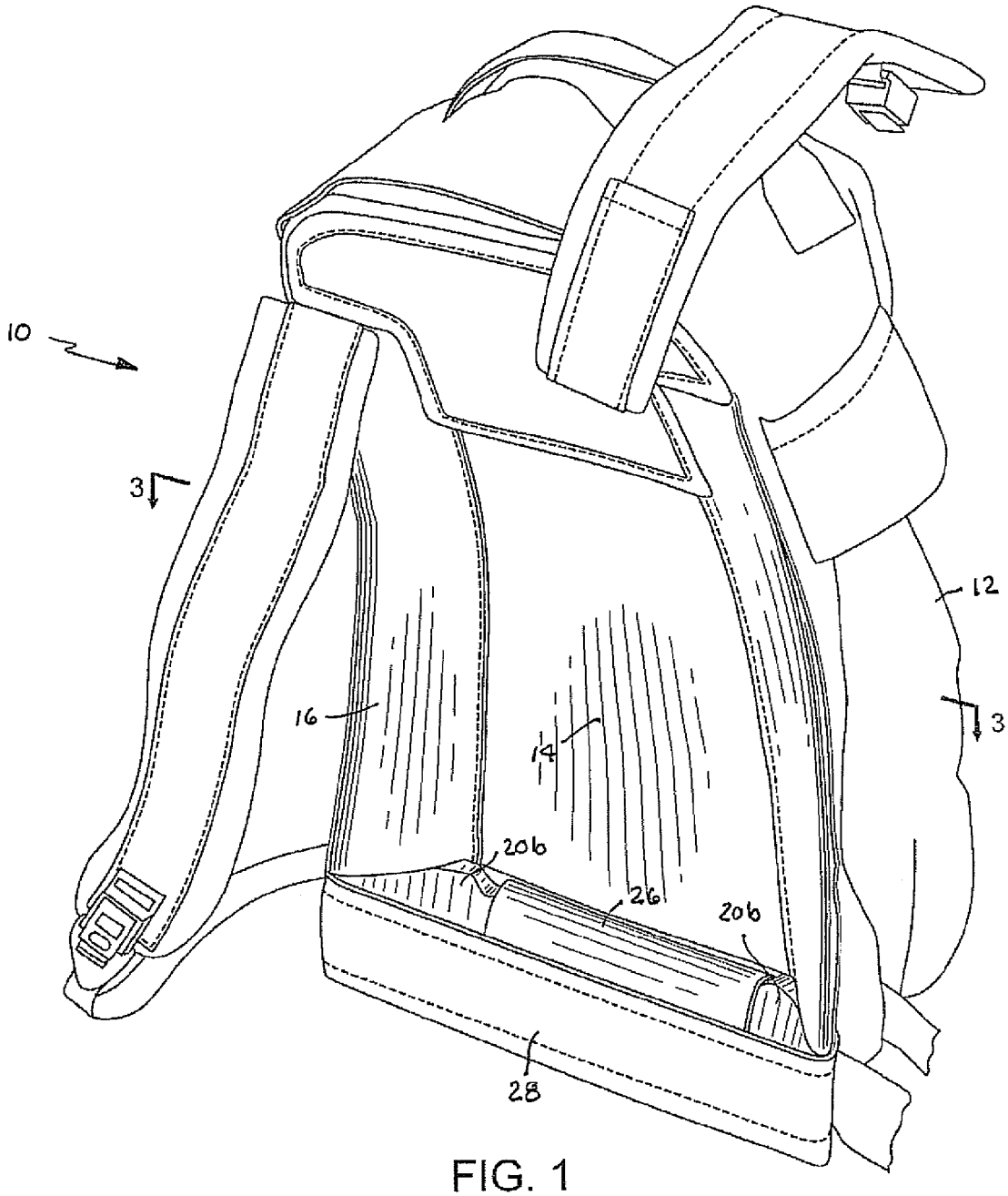
FIG. 1 is a front perspective view of one embodiment of a backpack in accordance with the present invention.
Figure 2:
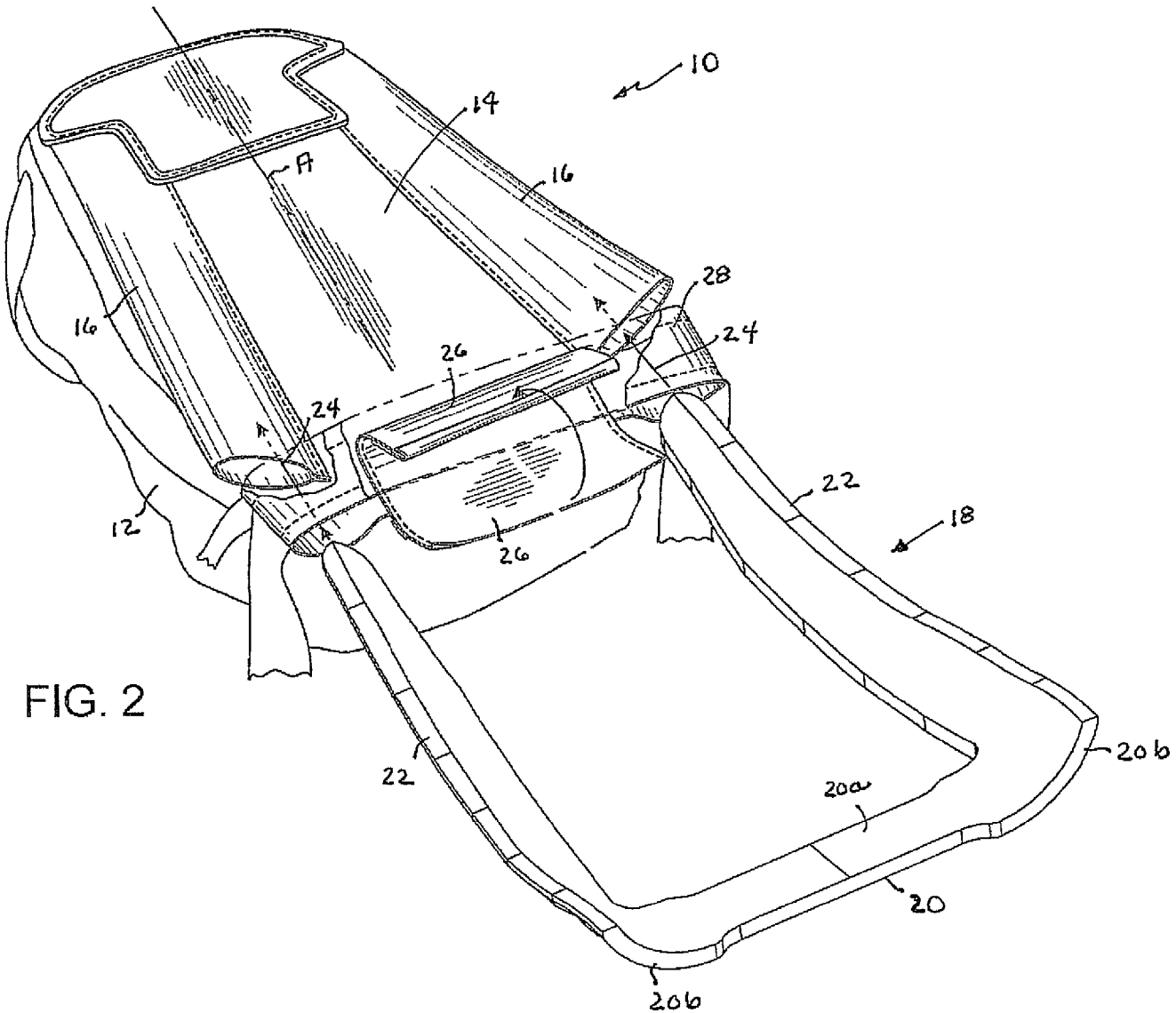
FIG. 2 is a bottom perspective view showing the partial perimeter frame extracted from the backpack.
Figure 3:
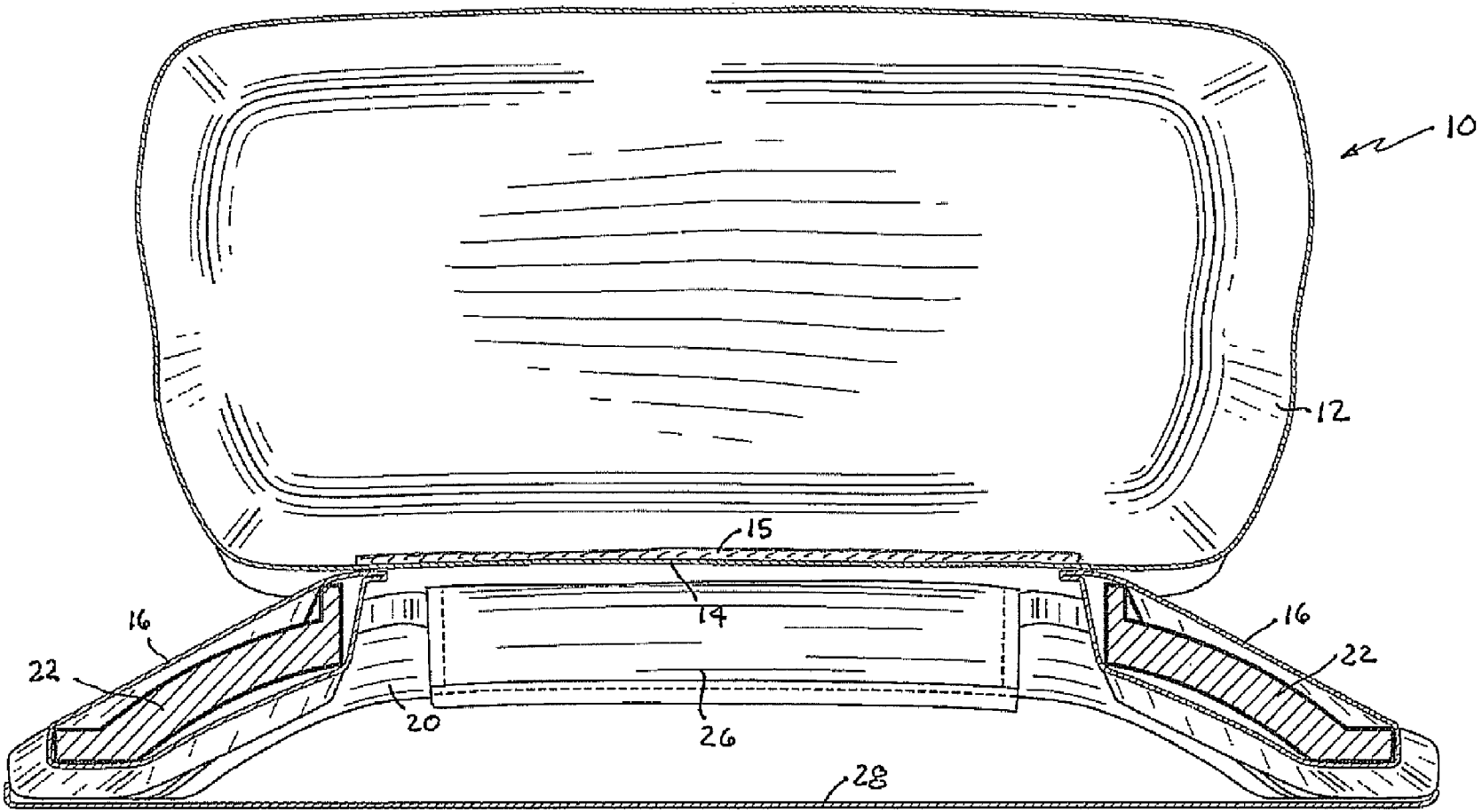
FIG. 3 is a cross sectional view taken on line 3-3 of FIG. 1.

With reference initially to FIGS. 1-3, a backpack in accordance with one embodiment of the invention is generally depicted at 10. The backpack includes a load carrying section 12 having a forwardly facing flexible front panel 14. The load carrying section is comprised principally of a fabric, with the stiffness of the front panel preferably being greater than the stiffness of the fabric. As shown in FIG. 3, the front panel can be stiffened by an additional sheet 15 adhered or otherwise integrally joined to its interior surface. Sheet 15 may comprise a foam or other rubber-like material which provides a cushioning effect.

A pair of mutually spaced sleeves 16 are joined to and border the sides of the panel 14. As can best be seen in FIG. 2, the sleeves 16 are inclined laterally inwardly towards a central axis "A" of the backpack, and are closed at the top and open at the bottom.

Figure 6:
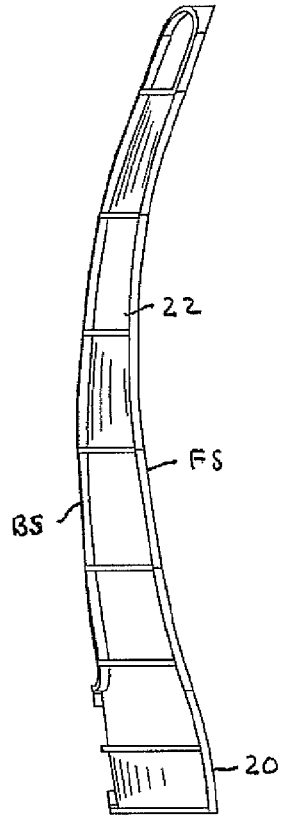
FIG. 6 is a side view of the partial perimeter frame.
Figure 7:
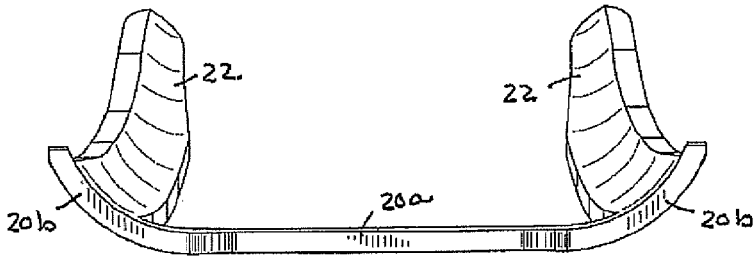
FIG. 7 is a bottom view of the partial perimeter frame.
Figure 8:
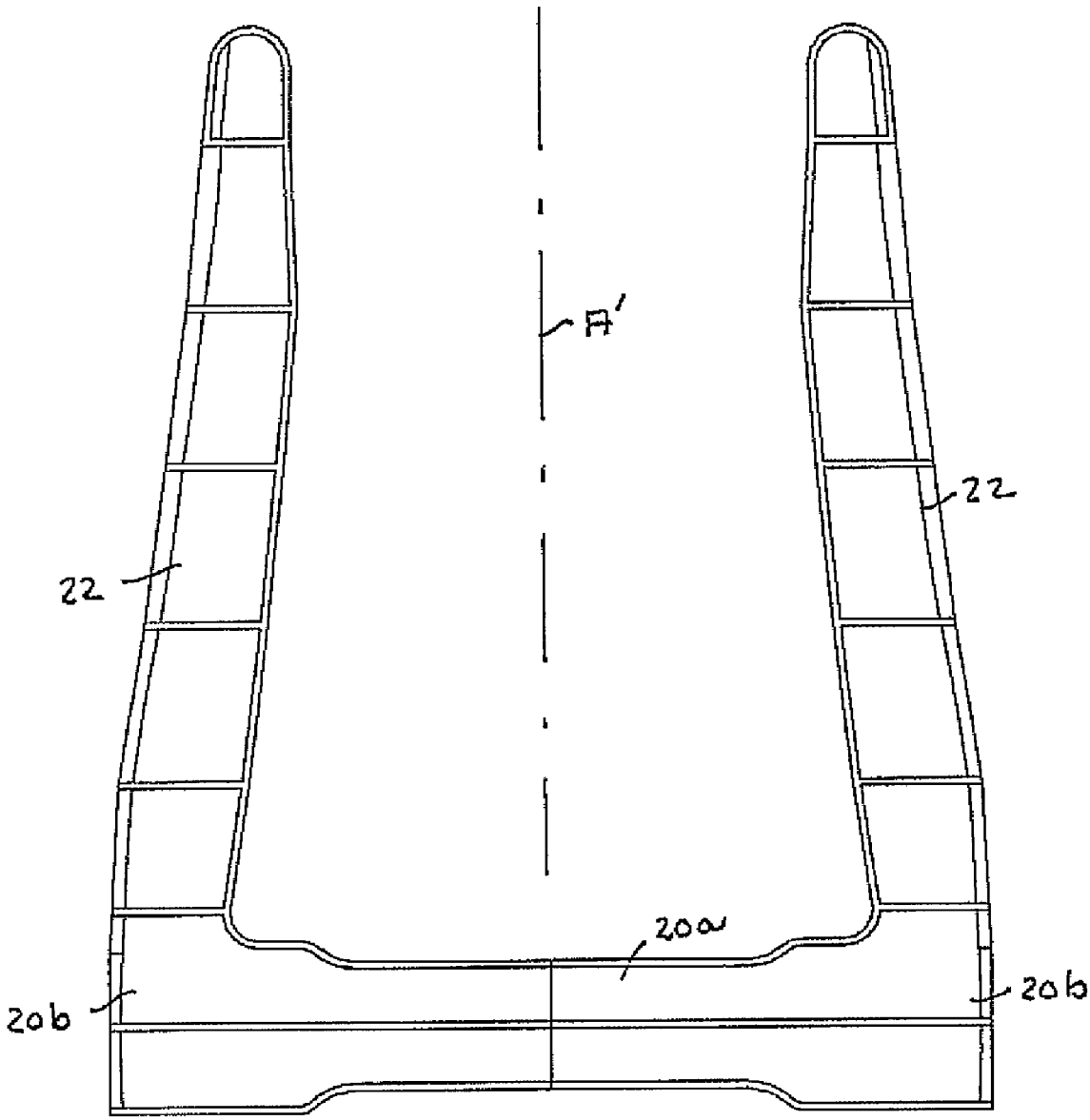
FIG. 8 is a front view of the partial perimeter frame.

An injection molded partial perimeter generally U-shaped frame 18 is assembled into the backpack. With reference to FIGS. 5-8, it will be seen that the frame 18 has a forwardly facing front side "FS" and a back side "BS". The frame includes a base 20 having a generally flat midsection 20*a* with forwardly curved end sections 20*b*. A pair of mutually spaced arms 22 project from the end sections 20*b*. As can best be seen in FIG. 8, the 22 arms are inclined laterally inwardly towards a central axis A' corresponding to the central axis A of the backpack. FIG. 6 illustrates the general concavity of the arms on their front sides. It will be seen from FIG. 5 (see in particular the profile of the left hand arm) that the arms have longitudinally twisted spiral configurations, with a degree of twist that gradually diminishes from the base 20 to the distal upper ends of the arms.

Figure 4:
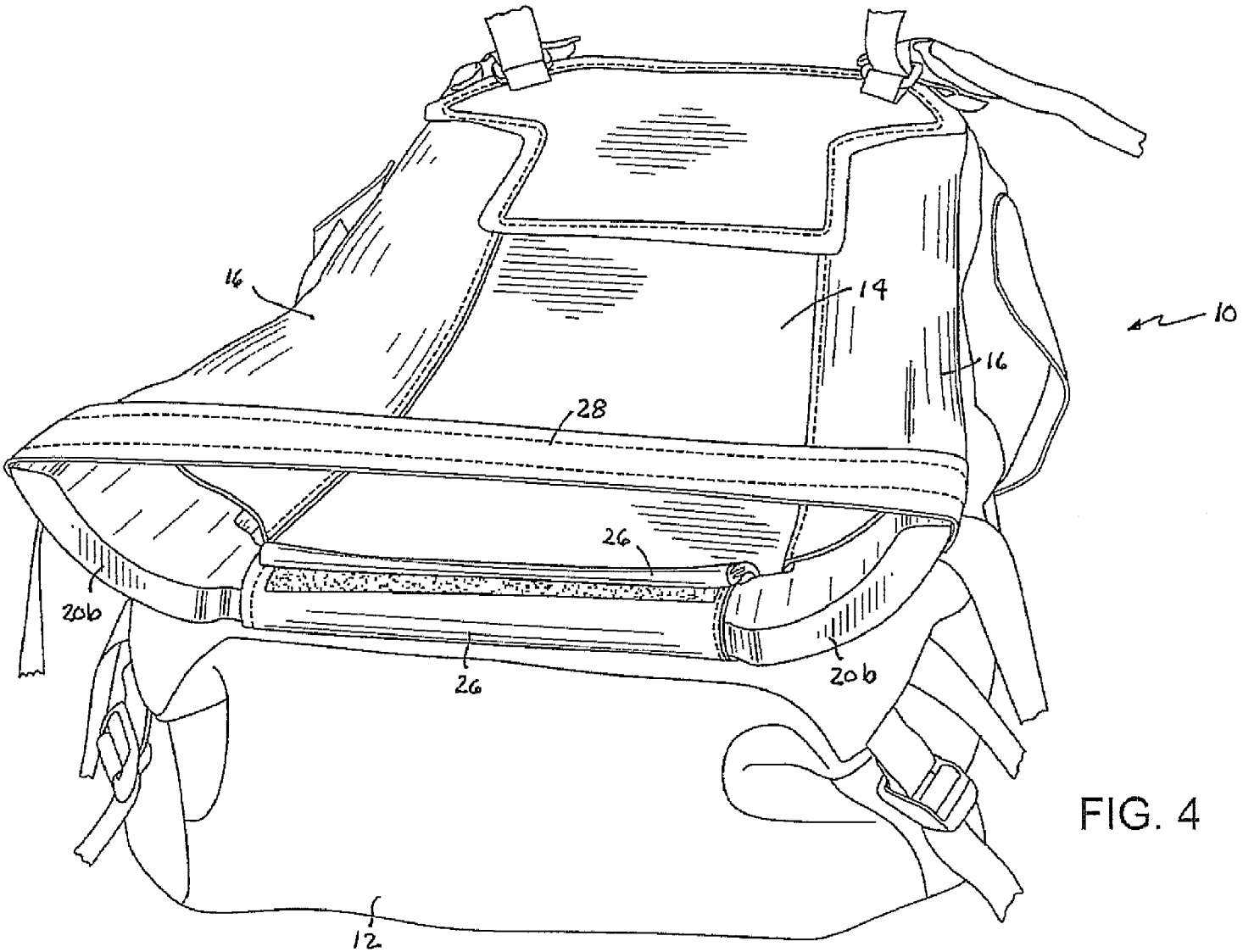
FIG. 4 is a bottom perspective view from a different angle with the partial perimeter frame fully inserted into the backpack.
Figure 5:
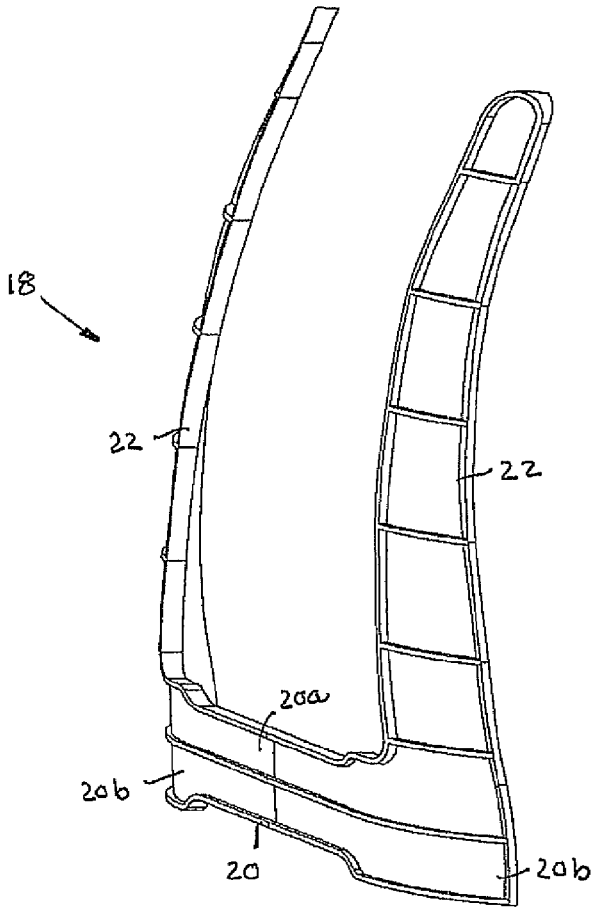
FIG. 5 is a perspective view of the partial perimeter frame.

As shown in FIG. 2, the frame 18 is configured for assembly into the backpack in the direction indicated by arrows 24. When thus assembled, as depicted in FIGS. 1, 3, and 4, the frame arms 22 are received in the sleeves 16, with the base 20 of the frame bordering the bottom of the front panel 14. Retainer flaps 26 with Velcro fastening strips surround the base midsection 20*a* and thus serve to retain the frame in its inserted position.

A flexible web 28 extends between the end sections 20*b* of the frame base. The web is spaced forwardly from and is generally parallel to the midsection 20*a* of the frame base.

Figure 10:
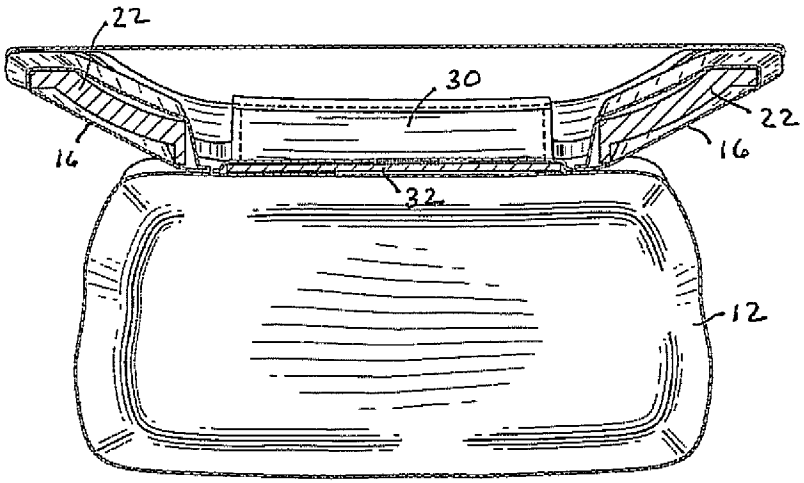
FIG. 10 is a cross sectional view of the alternative embodiment backpack with the partial perimeter frame and the stiffening plate fully inserted in their operative positions.
Figure 9:
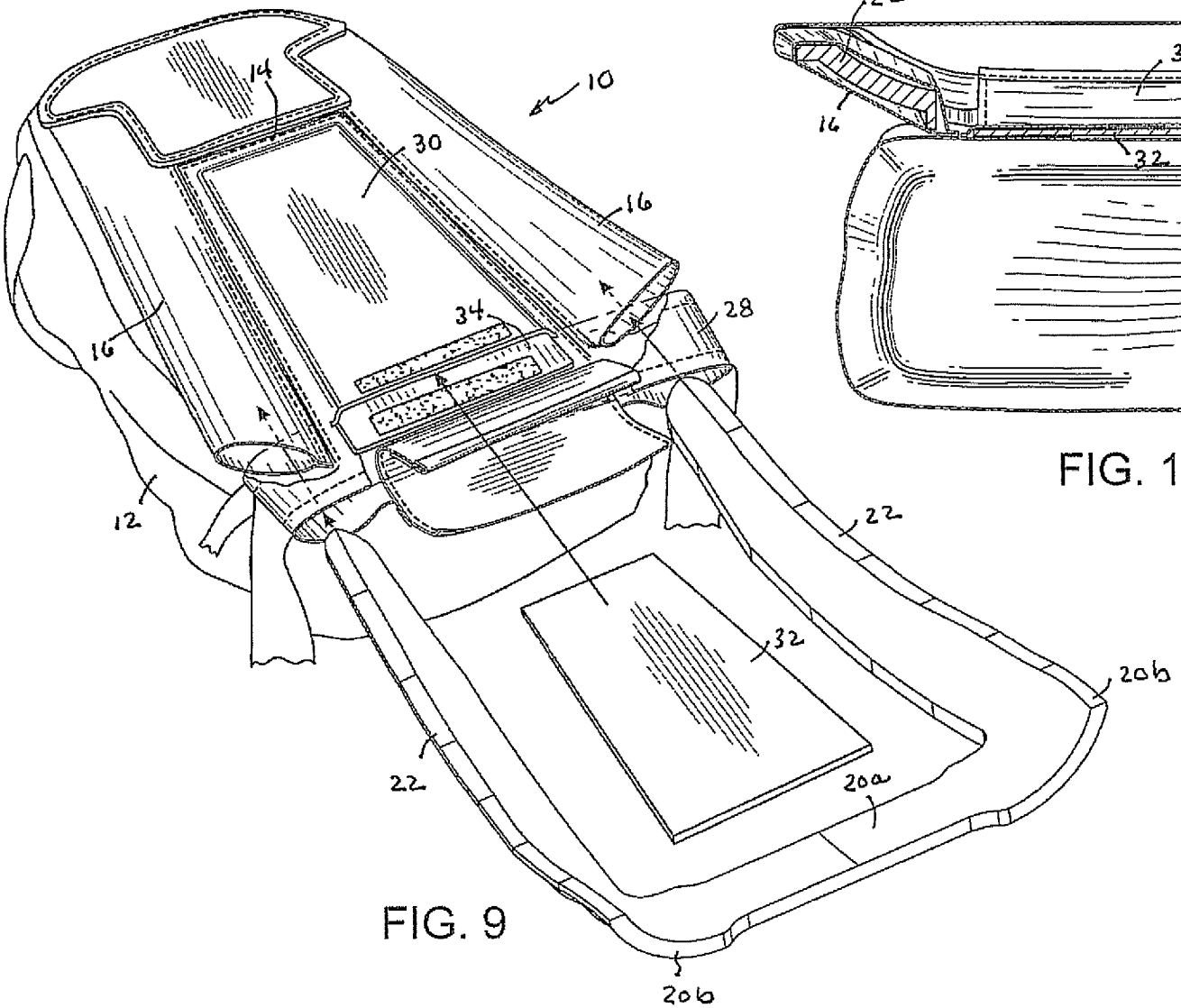
FIG. 9 is a bottom perspective view of an alternative embodiment of a backpack in accordance with the present invention, showing both the partial perimeter frame and a stiffening plate for increasing the stiffness of the front panel in extracted positions.

In the embodiment depicted in FIGS. 9 and 10, the front panel 14 defines a pocket 30 located between the sleeves 16. A flexible stiffening plate 32 is configured and dimensioned for insertion into the pocket 30 through its open bottom. The pocket bottom may then be closed, either by a closure flap 34 as shown, or by stitching.

In both embodiments, the position of the front panel 14 between the sleeves 16 and its increased stiffness as compared to that of the remainder of the backpack fabric serves to control frame movement. The front panel keeps the distal ends of the frame arms 22 from moving too far apart or too close together. However, both the arms 22 and the front panel 14 can assume a concave shape to create space for the wearer's back-borne equipment while efficiently transferring load to the frame's base 20.

The forwardly concave configuration of the frame arms 22 creates space for back-borne equipment, and their gradually diminishing longitudinal twist provides structural stiffness that serves to resist pealing away from the wearer's back under load. All of this is achieved without compromising movement associated with walking as shoulders and hips move in opposite directions.

The web 28 extending between the base end sections 20*b* of the frame is tensioned by frame flexure, thus serving as a comfortable trampoline-style pad at the base of the wearer's back.

I claim:

1. A backpack comprising: a load carrying section having a forwardly facing front panel; a pair of mutually spaced sleeves joined to and bordering sides of said front panel; and a generally U-shaped frame having a base bordering a bottom of said front panel, said base having a generally flat midsection with forwardly curved resiliently flexible end sections, and mutually spaced arms with longitudinally twisted spiral configurations projecting in cantilever fashion from said end sections and into said sleeves.

2. The backpack of claim 1 wherein said load carrying section is comprised of a fabric, and wherein said front panel has a stiffness greater than the stiffness of said fabric.

3. The backpack of claim 1 wherein said front panel defines a pocket between said sleeves, and wherein a flexible stiffening plate is contained in said pocket.

4. The backpack of claim 3 wherein said sleeves and said pocket have bottom openings configured and arranged respectively to accommodate insertion of said arms and said stiffening plate.

5. The backpack of claim 1 wherein said sleeves and said arms are inclined laterally inwardly towards a central axis of the backpack.

6. The backpack of claim 1 further comprising a flexible web extending between the end sections of said base at a location spaced forwardly from the midsection of said base.

7. The backpack of claim 1 wherein said front panel, said sleeves and the arms of said frame are configured to coact in defining a forwardly facing generally concave recess.

8. The backpack of claim 1 wherein the arms of said frame are generally concave in the forwardly facing direction.

9. The backpack of claim 1 or 8 wherein the arms of said frame have a degree of twist that gradually diminishing from the base of said frame to the distal ends of said arms.

10. A backpack comprising: a load carrying section having a forwardly facing front panel, said load carrying section being stitched from a fabric, and said front panel having a stiffness greater than the stiffness of said fabric; a pair of mutually spaced sleeves joined to and bordering sides of said front panel; and a generally U-shaped frame having a base bordering a bottom of said front panel, said base having a generally flat midsection with forwardly curved resiliently flexible end sections, and mutually spaced arms with longitudinally twisted spiral configurations projecting in cantilever fashion from said end sections and into said sleeves, said sleeves and said arms being inclined laterally inwardly towards a central axis of said backpack.

11. A backpack comprising:

a load carrying section having a forwardly facing front panel;

a pair of mutually spaced sleeves joined to and bordering sides of said front panel; and a generally U-shaped frame having a base with a generally flat midsection bordering a bottom of said front panel, said base having forwardly curved resilient flexible end sections from which mutually spaced arms project in cantilever fashion into said sleeves, said sleeves and said arms being inclined laterally inwardly towards a central axis of said backpack.

* * * * *